US007052324B2

(12) United States Patent
Miksche et al.

(10) Patent No.: US 7,052,324 B2
(45) Date of Patent: May 30, 2006

(54) PLUG CONNECTOR HAVING A DAMPING ELEMENT

(75) Inventors: Dieter Miksche, Gadernheim (DE); Volker Seipel, Bensheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/116,482

(22) Filed: Apr. 28, 2005

(65) Prior Publication Data

US 2006/0009077 A1 Jan. 12, 2006

(30) Foreign Application Priority Data

Apr. 28, 2004 (DE) ..... 10 2004 020 933 A

(51) Int. Cl.
*H01R 13/66* (2006.01)

(52) U.S. Cl. ..... 439/620

(58) Field of Classification Search ..... 439/620
See application file for complete search history.

(56) References Cited

U.S. PATENT DOCUMENTS

| | | | | |
|---|---|---|---|---|
| 5,213,522 | A * | 5/1993 | Kojima | 439/620 |
| 5,895,282 | A * | 4/1999 | Little | 439/332 |
| 6,234,843 | B1 * | 5/2001 | Pavlovic | 439/620 |
| 6,431,916 | B1 * | 8/2002 | Asao | 439/620 |
| 6,461,184 | B1 * | 10/2002 | Nimura | 439/620 |

FOREIGN PATENT DOCUMENTS

| | | |
|---|---|---|
| DE | 100 25 295 A1 | 1/2002 |
| DE | 101 02 688 C1 | 9/2002 |
| EP | 1 009 069 A2 | 6/2000 |
| EP | 1 117 159 A2 | 7/2001 |

* cited by examiner

*Primary Examiner*—Tho D. Ta
(74) *Attorney, Agent, or Firm*—Barley Snyder LLC

(57) ABSTRACT

A plug, in particular an igniter plug, which has a damping element on a contact element of the plug is described. In order to assemble it the damping element has a passageway, which is substantially matched to the crimp region of the contact element in cross-section. As a result of the arrangement of the damping element on the contact element, a small construction of the plug is made possible. Preferably, the crimp regions are arranged outside the plug housing, so that it is possible to install the cables later without having to open the plug housing.

19 Claims, 5 Drawing Sheets

PLUG CONNECTOR HAVING A DAMPING ELEMENT

FIELD OF THE INVENTION

The invention relates to an electrical connector and, in particular an igniter plug.

BACKGROUND

Plugs, and in particular igniter plugs for connecting to an igniter cell of an airbag system, have a contact element and a damping element usually formed of a ferrite which is used to damp high-frequency signals. The contact element has at one end a contact region and at the other end a crimp region at which an electrical conductor is installed. The damping element is arranged in the region of the electrical conductor and provided with passageways through which the electrical conductors are fed. The passageways have substantially circular cross-sections matched to the cross-section of the conductors.

SUMMARY

An object of the invention among others, is to provide an improved plug which has more flexibility in further processing. Another object is to provide a more compact plug.

These and other objects of the invention are achieved by a plug that can be sold pre-assembled with the contact element and the damping element, for example a ferrite element. The electrical conductors can hence be connected independently of the manufacturer of the plug. This gives more flexibility in the manufacture of a set of cables with the plug, since the plug is pre-assembled and the cables can be installed at a later point. Furthermore, the plug has the advantage that a smaller construction is achieved, since the damping element is arranged on the contact element.

In an embodiment of the invention, the cross-section of a passageway has substantially the same shape as the cross-section of the region in which the contact element is connected before a cable is installed. In this way, it is on the one hand possible to push the connection region of the contact element through the passageway of the damping element, although the region of the contact element arranged in the damping element is almost filled up and is surrounded by the damping element with a fairly close fit. In this way, the damping effect of the damping element on disruptive electrical signals is substantially maintained despite the possibility of pushing the damping element over the connection region and onto the contact element.

BRIEF DESCRIPTION OF THE DRAWINGS

The invention will be explained in more detail below with reference to the figures, in which.

DETAILED DESCRIPTION OF THE EMBODIMENTS

Figure 1:
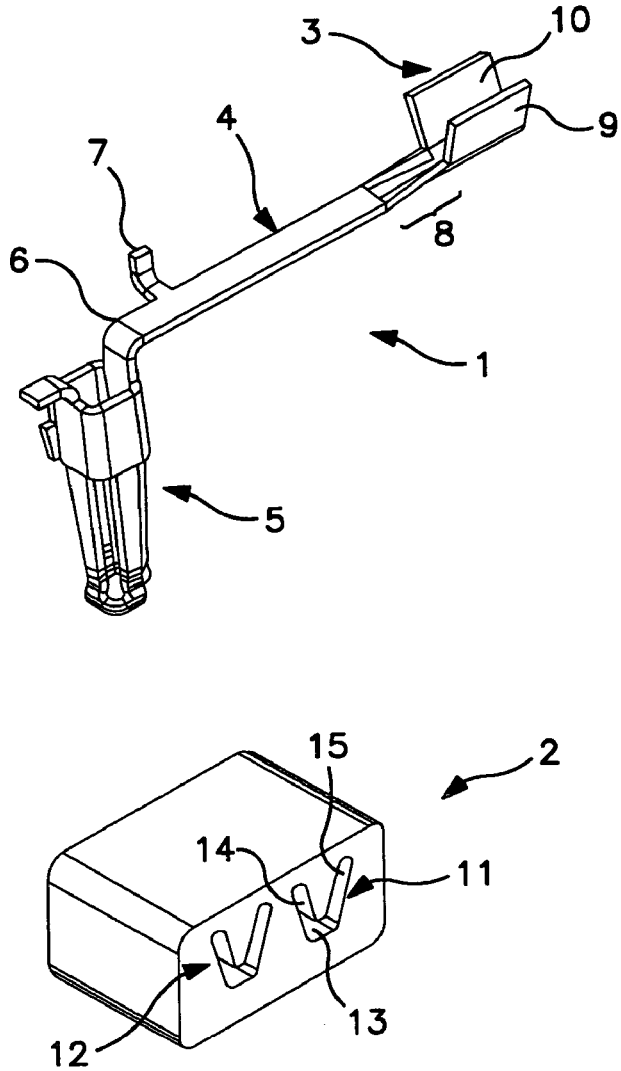
FIG. 1 shows a first embodiment of a contact element and a first embodiment of a damping element.

FIG. 1 shows, in perspective illustrations, a contact element 1 and a damping element 2 which may take the form of a ferrite element. Instead of ferrite, other materials which give damping of disruptive electrical signals may also be used. The contact element 1 has substantially two sections which are arranged at a right angle to one another. Provided in the first section is a crimp region 3 which extends into a planer region 4. The crimp region 3 facilitates connecting an electrical conductor. Instead of a crimp region 3, it is also possible to provide a solder region or a weld region for soldering or welding a conductor onto the contact element 1. The planer region 4 extends by way of a downward 90° bend 6 into a contact region 5 in the second section. The contact region 5 is made in the form of a contact tube into which a contact pin may be urged in order to make contact. Close to the bend 6, laterally with respect to the planer region 4, there is arranged a latching tab 7. The planer region 4 has a substantially rectangular cross-section which extends into a U-shaped transition region 8 adjacent the crimp region 3. In the crimp region 3, the contact element 1 has first and second tabs 9, 10 on respective opposing sides. The crimp region 3 is U-shaped in cross-section. The contact element 1 is made in one piece from an electrically conductive material, preferably a metal plate, by stamping and forming.

The damping element 2 may be made from a ferrite material and has a rounded cuboid shape in which two passageways 11, 12 are made. The passageways 11, 12 extend from a front side through to a rear side of the damping element 2. Seen in cross-section, the passageways 11, 12 have a surface area which is substantially matched to the cross-sectional surface area of the crimp region 3 of the contact element 1. The first and second passageways 11, 12 are preferably identical in construction. The cross-sectional surface area of the passageways 11, 12 has a contact region 13 which is substantially rectangular in shape. The contact region 13 extends upwards along two opposing sides respectively into a first and a second tab region 14, 15. The contact region 13 corresponds substantially to the cross-section of the planer region 4 of the contact element 1.

Figure 2:
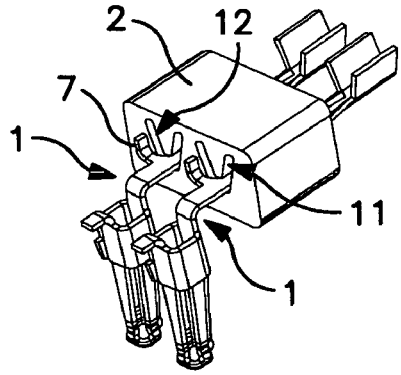
FIG. 2 shows a component having a damping element pushed onto two contact elements.

FIG. 2 shows a component having the damping element 2, with two passageways 11, 12, into each of which a contact element 1 has been inserted. When the contact elements 1 are inserted in, the crimp region 3 is pushed through the first or the second passageways 11, 12 until the latching tab 7 abuts against the damping element 1. The fact that the cross-sections of the contact element 1 and the passageways 11, 12 are matched to one another provides the possibility of pushing the contact element 1 through the passageways 11, 12, with the planer region 4 surrounded by the damping element 2 with little play when the end position as illustrated in FIG. 2 is reached. This is substantially achieved in that the planer region 4 has the same cross-sectional shape as the contact region 13 of the first and the second passageways 11, 12. This means that the electrical damping action of the damping element 2 on high-frequency disruptive signals in the contact elements 1 is not impaired despite the urging the damping element 2 onto the contact elements 1.

The invention is not restricted to the cross-sections for the passageways 11, 12 and the contact elements 2 selected in FIGS. 1 and 2, but may also be applied to other cross-sectional geometries for both the contact element 1 and the passageways 11, 12. The only crucial point here is that the passageways 11, 12 are constructed in such a way that the damping element 2 can be pushed onto the contact element 1 and, in the end position, in the region arranged in the damping element 2 the contact element 1 is surrounded with a fairly close fit and as far as possible over the entire periphery by the damping element 2, so that the damping electromagnetic effect of the damping element 2 is maintained.

Figure 3:
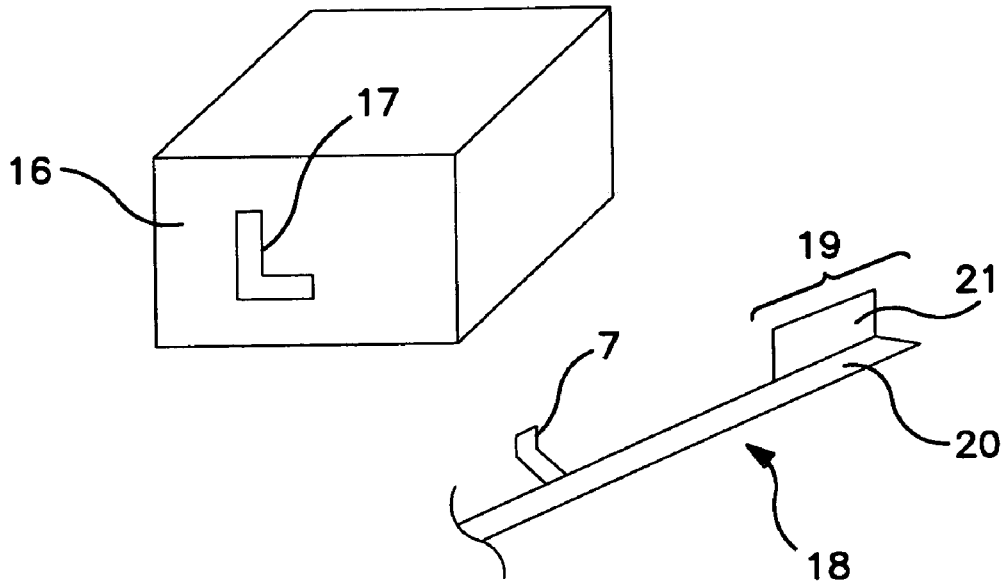
FIG. 3 shows a diagrammatic illustration of a second embodiment of a contact element and a second embodiment of a damping element.

FIG. 3 shows, in a diagrammatic illustration, a further embodiment of a second damping element 16 which may take the form of a ferrite element and has a third passageway 17. The third passageway 17 has a substantially angled rectangular shape with two rectangular surfaces merging into one another. Furthermore, FIG. 3 illustrates a first section of a second contact element 18 which is constructed substantially to correspond to the contact element 1. Unlike the crimp region 3 of the contact element 1, a second crimp region 19 of the second contact element 18 has an angled rectangular shape in cross-section, corresponding substantially to the rectangular shape of the third passageway 17. The second crimp region 19 substantially comprises a rectangular second planer region 20 adjoined laterally to a third tab 21. The cross-section of the second crimp region 19 and the cross-section of the third passageway 17 are matched to one another in such a way that the second crimp region 19 of the second contact element 18 can be urged through the third passageway 17 and the second planer region 20 is surrounded by the second damping element 16 with a small amount of play.

Figure 4:
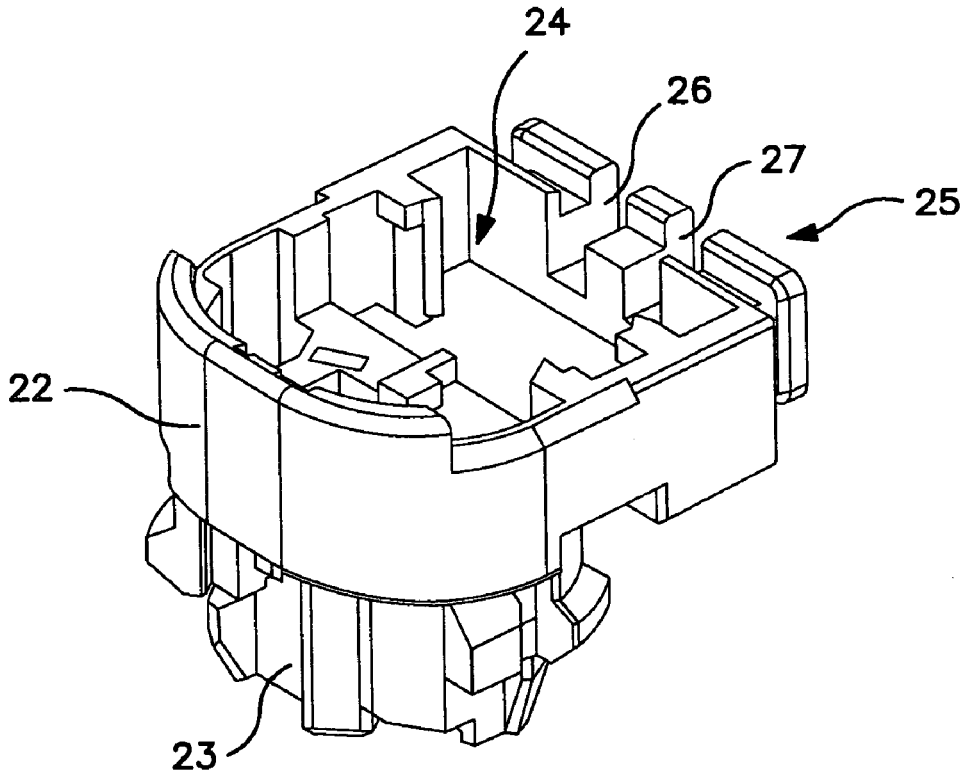
FIG. 4 shows a base housing of a plug.

FIG. 4 shows a perspective illustration of a plug housing 22 which in the embodiment illustrated is constructed as part of an igniter plug for an airbag system of a motor vehicle. The plug housing 22 has a downwardly projecting mating portion 23 which is provided for inserting into an igniter cell of an igniter device of an airbag triggering system. In the upper region, a cutout 24 is provided in the plug housing 22 for receiving the pre-assembled component with the damping element 2 and the contact elements 1, as illustrated in FIG. 2. During assembly, the two contact regions 5 of the contact elements 1 are inserted into corresponding contact holes in the mating portion 23, which lead downwards and serve to receive contact pins of the igniter cell. Two contact cutouts 26, 27 are forward in a side wall 25 next to one another.

Figure 5:
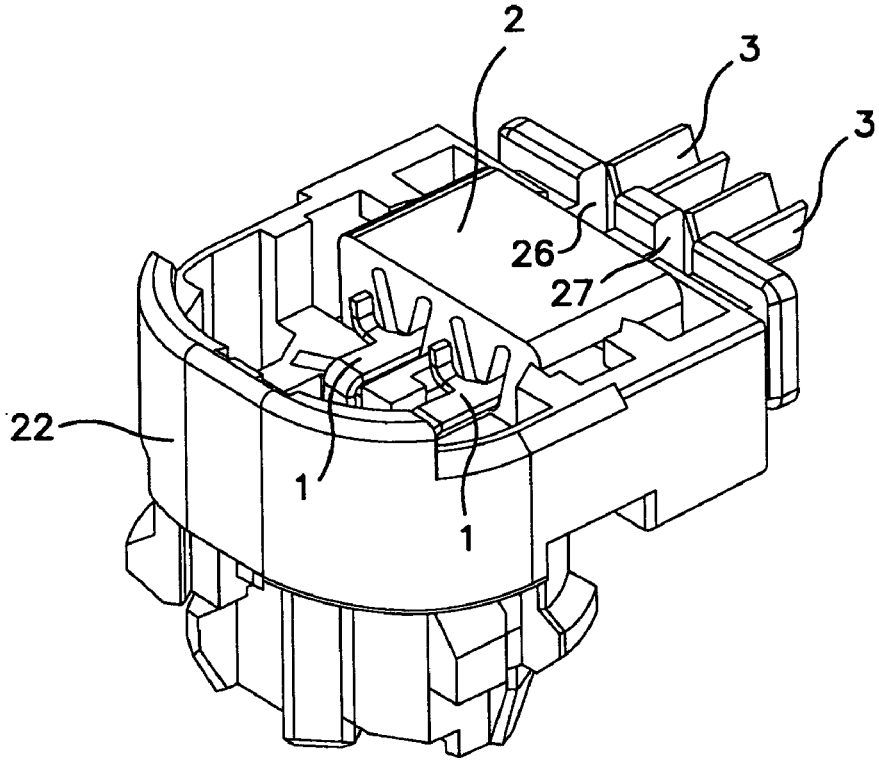
FIG. 5 shows the base housing of the plug with the damping element mounted and the contact elements mounted.

FIG. 5 shows the plug housing 22 with two contact elements 1 inserted and a damping element 2 inserted. The crimp regions 3 of the two contact elements 1 are arranged outside the plug housing 22, with the contact elements 1 laid in the first and the second contact cutouts 26, 27 respectively.

Figure 6:
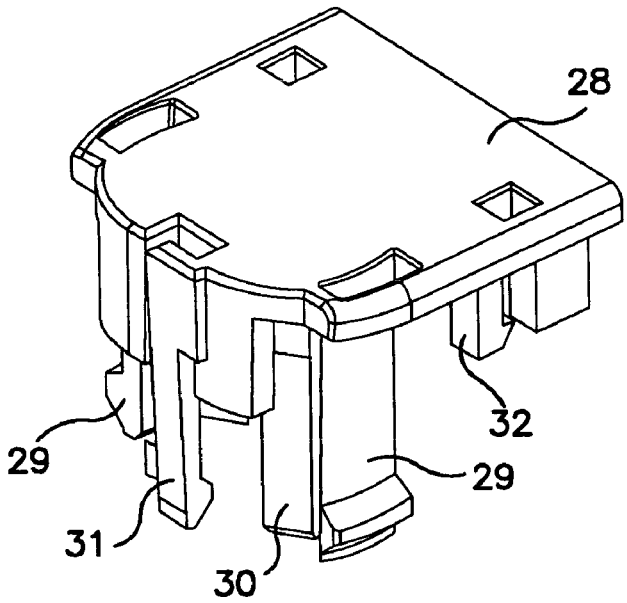
FIG. 6 shows a cover plate with latching features.

FIG. 6 shows a housing cover 28 which has latching tabs 29, a locking pin 30, a latching hook 31 and a holding hook 32. The housing cover 28 is urged into the plug housing 22 over the cutout 24. The latching hook 29, the locking pin 30, the latching hook 31 and the holding hook 32 are urged into corresponding cutouts in the plug housing 22 as shown in FIG. 7.

Figure 7:
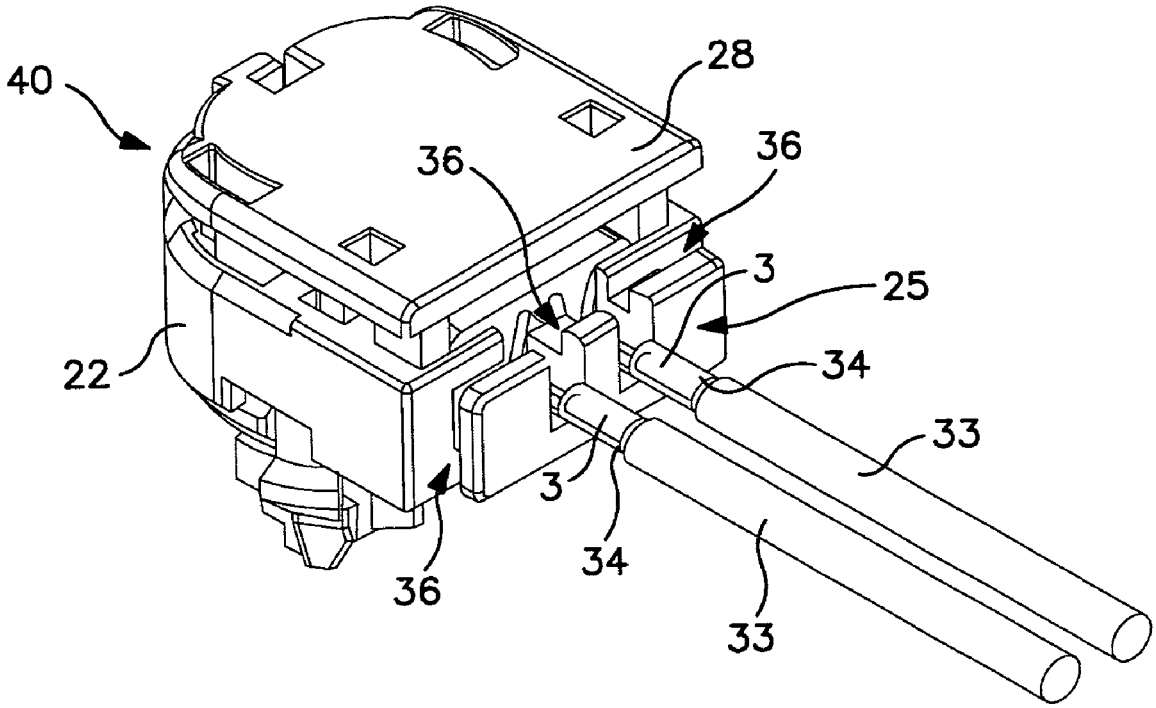
FIG. 7 shows a pre-assembled plug with the cables installed.

FIG. 7 shows a plug housing 22 with a housing cover 28. The housing cover 28 is in a pre-latched position, in which the housing cover 28 is arranged at a fixed spacing over the plug housing 22. To latch the plug in place, the plug housing 22 is urged into a correspondingly shaped igniter cell and latched therein as a result of the housing cover 28 being urged down. Installed in the crimp regions 3 are cables 33 so that an electrically conductive connection is made between the contact elements 1 and conductors 34 of the cables 33. Without the cables 33 installed, the plug illustrated in FIG. 7 represents a pre-assembled plug which can be supplied to the customer who provide appropriate cables 33. This gives enhanced flexibility in the manufacture of sets of cables with the plugs. A peripheral latching groove 36 is formed on the side wall 25 and is provided in order to secure a strain relief element 35.

Figure 8:
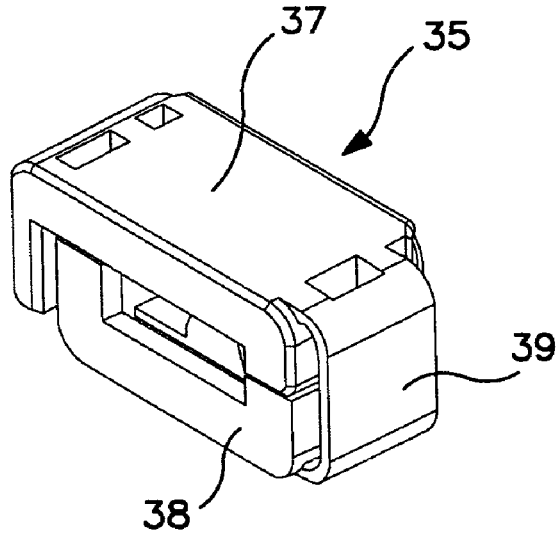
FIG. 8 shows a strain relief and FIG. 9 shows a plug with the cables mounted and the strain relief mounted.

FIG. 8 shows, in a perspective illustration, of a strain relief 35 which may be urged into the latching groove 36 in the side wall 25.

Figure 9:
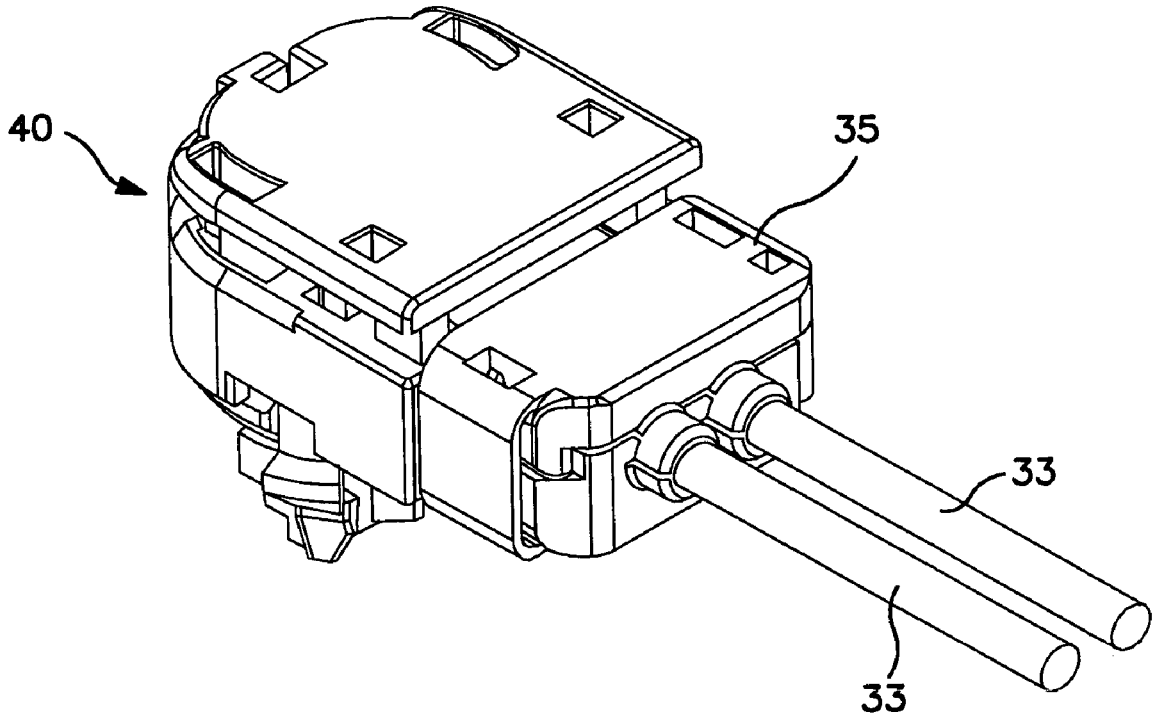

The strain relief 35 comprises two U-shaped holding elements 37, 38 which are held together by way of a holding bracket 39. The strain relief 35 has clamping elements which make a clamping connection with the insulation of the cables 33. FIG. 9 shows a plug with the strain relief element 35 secured to the plug 40 by way of the latching groove 36.

What is claimed is:

1. A plug connector comprising:

at least one electrical contact element having a contact region located on a first end thereof and a connection region located on the second end thereof;

a damping element having a passageway which receives the contact element such that the damping element is arranged between the contact region and the connection region the cross-section of the passage way is substantially matched to the cross-section of the connection region in such a way that the connection region may be urged through the damping element and the passageway surrounds the contact element; and, the connection region has a planer region adjoined by at least one lateral tab, the cross-section of the passageway has a contact region adjoined laterally by at least one tab region, with the contact region being matched to the planer region of the connection region and to the cross-section of a planer region of the contact element arranged in the passageway, so that the connection region may be pushed through the passageway and the planer region is surrounded by the damping element with a fairly tight fit.

2. The plug according to claim 1, wherein the connection region has a U shaped cross-section, and the passageway also has a U shaped cross-section.

3. The plug according to claim 1, wherein the contact element has a latching tab which is arranged between the contact region and the connection region and limits how far the contact element may be urged into the passageway.

4. The plug according to claim 1, wherein the contact element has substantially two straight sections, with the connection region being arranged in the first section and the contact region being arranged in the second section, and the two sections being arranged at an angle to one another.

5. The plug according to claim 1, wherein the damping element is arranged inside a plug housing and the connection region is arranged outside the plug housing.

6. The plug according to claim 5, wherein the plug housing has a holding means for securing a strain relief for an electrical cable to be installed in the connection region.

7. A plug connector comprising:

at least one electrical contact element having a contact region located on a first end thereof and a connection region located on the second end thereof;

a damping element having a passageway which receives the contact element such that the damping element is arranged between the contact region and the connection region, the cross-section of the passageway is substantially matched to the cross-section of the connection region in such a way that the connection region may be urged through the damping element and the passageway surrounds the contact element; and, the contact element has a latching tab which is arranged between the contact region and the connection region and limits how far the contact element may be urged into the passageway.

8. The plug according to claim 7, wherein the connection region has a U shaped cross-section, and the passageway also has a U shaped cross-section.

9. The plug according to claim 7, wherein the connection region has a planer region adjoined by at least one lateral tab, the cross-section of the passageway has a contact region adjoined laterally by at least one tab region, with the contact region being matched to the planer region of the connection region and to the cross-section of a planer region of the contact element arranged in the passageway, so that the connection region may be pushed through the passageway and the planer region is surrounded by the damping element with a fairly tight fit.

10. The plug according to claim 7, wherein the contact element has substantially two straight sections, with the connection region being arranged in the first section and the contact region being arranged in the second section, and the two sections being arranged at an angle to one another.

11. The plug according to claim 7, wherein the damping element is arranged inside a plug housing and the connection region is arranged outside the plug housing.

12. The plug according to claim 11, wherein the plug housing has a holding means for securing a strain relief for an electrical cable to be installed in the connection region.

13. A plug connector comprising:

at least one electrical contact element having a contact region located on a first end thereof and a connection region located on the second end thereof, the connection region being a crimp region; and, a damping element having a passageway which receives the contact element such that the damping element is arranged between the contact region and the connection region, the cross-section of the passageway is substantially matched to the cross-section of the connection region in such a way that the connection region may be urged through the damping element and the passageway surrounds the contact element.

14. The plug according to claim 13, wherein the connection region has a U shaped cross-section, and the passageway also has a U shaped cross-section.

15. The plug according to claim 13, wherein the connection region has a planer region adjoined by at least one lateral tab, the cross-section of the passageway has a contact region adjoined laterally by at least one tab region, with the contact region being matched to the planer region of the connection region and to the cross-section of a planer region of the contact element arranged in the passageway, so that the connection region may be pushed through the passageway and the planer region is surrounded by the damping element with a fairly tight fit.

16. The plug according to claim 13, wherein the contact element has a latching tab which is arranged between the contact region and the connection region and limits how far the contact element may be urged into the passageway.

17. The plug according to claim 13, wherein the contact element has substantially two straight sections, with the connection region being arranged in the first section and the contact region being arranged in the second section, and the two sections being arranged at an angle to one another.

18. The plug according to claim 13, wherein the damping element is arranged inside a plug housing and the connection region is arranged outside the plug housing.

19. The plug according to claim 18, wherein the plug housing has a holding means for securing a strain relief for an electrical cable to be installed in the connection region.

* * * * *